US008043059B1

(12) United States Patent
Liang

(10) Patent No.: US 8,043,059 B1
(45) Date of Patent: Oct. 25, 2011

(54) TURBINE BLADE WITH MULTI-VORTEX TIP COOLING AND SEALING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 687 days.

(21) Appl. No.: 12/209,550

(22) Filed: Sep. 12, 2008

(51) Int. Cl.
*F01D 5/08* (2006.01)

(52) U.S. Cl. ..... 416/97 R; 416/96 R

(58) Field of Classification Search ..... 416/96 R, 416/97 R
See application file for complete search history.

(56) References Cited

U.S. PATENT DOCUMENTS

| | | | | |
|---|---|---|---|---|
| 6,164,914 | A * | 12/2000 | Correia et al. | 416/97 R |
| 6,932,571 | B2 * | 8/2005 | Cunha et al. | 416/97 R |
| 7,537,431 | B1 * | 5/2009 | Liang | 416/95 |
| 2006/0153680 | A1 * | 7/2006 | Liang | 416/97 R |

* cited by examiner

*Primary Examiner* — Kiesha Bryant
*Assistant Examiner* — Mark Tornow
(74) *Attorney, Agent, or Firm* — John Ryznic

(57) ABSTRACT

A turbine blade with a blade tip having a plurality of vortex chambers formed below the blade tip surface, the vortex chambers flowing from the suction side to the pressure side of the airfoil. Each vortex chamber includes a metering inlet hole located on the side of the chamber at the suction side end such that the cooling air entering the chamber impinges onto the backside of the blade tip and then produces a vortex flow through the chamber. An exit slot is located at the end of each vortex chamber to produce impingement cooling on the backside of the pressure side wall prior to being discharged onto the outer surface of the blade near adjacent to the pressure side corner. Helical ribs extend along the vortex chambers to promote the formation of the vortex flow.

15 Claims, 5 Drawing Sheets

View C-C

View A-A

View B-B

View C-C

TURBINE BLADE WITH MULTI-VORTEX TIP COOLING AND SEALING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a turbine blade, and more specifically to a turbine blade with tip cooling.

2. Description of the Related Art Including Information Disclosed Under 37 CFR 1.97 and 1.98

In a gas turbine engine, especially an industrial gas turbine engine, the turbine includes stages of turbine blades that rotate within a shroud that forms a gap between the rotating blade tip and the stationary shroud. Engine performance and blade tip life can be increased by minimizing the gap so that less hot gas flow leakage occurs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built along the airfoil pressure side and suction side tip sections and extend from the leading edge to the trailing edge to provide edge cooling for the blade squealer tip. Also, convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section. FIG. 2 shows a profile view of the pressure side and FIG. 3 shows the suction side each with tip peripheral cooling holes for the prior art turbine blade of FIG. 1.

The blade squealer tip rail is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. The effectiveness induced by the pressure film cooling and tip section convective cooling holes become very limited.

BRIEF SUMMARY OF THE INVENTION

It is an object of the present invention to provide for a turbine blade with an improved tip cooling than the prior art blade tips.

It is another object of the present invention to provide for a turbine blade with less leakage across the tip gap than in the prior art blade tips.

It is another object of the present invention to provide for a turbine blade with greatly reduced tip section metal temperature.

It is another object of the present invention to provide for a turbine blade with improved life.

It is another object of the present invention to provide for an industrial gas turbine engine with improved performance and increased life over the prior art engines.

The present invention is a blade tip cooling and sealing design with a plurality of vortex tube cooling channels formed within the blade tip section each in parallel with each other and arranged to extend from the suction side to the pressure side along the direction of the hot gas flow over the tip, where each vortex tube channel includes an cooling air inlet located near the suction side wall and an outlet opening onto the tip near the pressure side wall. Each vortex tube channel includes helical ribs extending along the channel to increase the heat transfer coefficient. The blade tip is covered with an abrasive tip material to form a tip gap with a blade outer air seal of the engine.

DETAILED DESCRIPTION OF THE INVENTION

Figure 1:
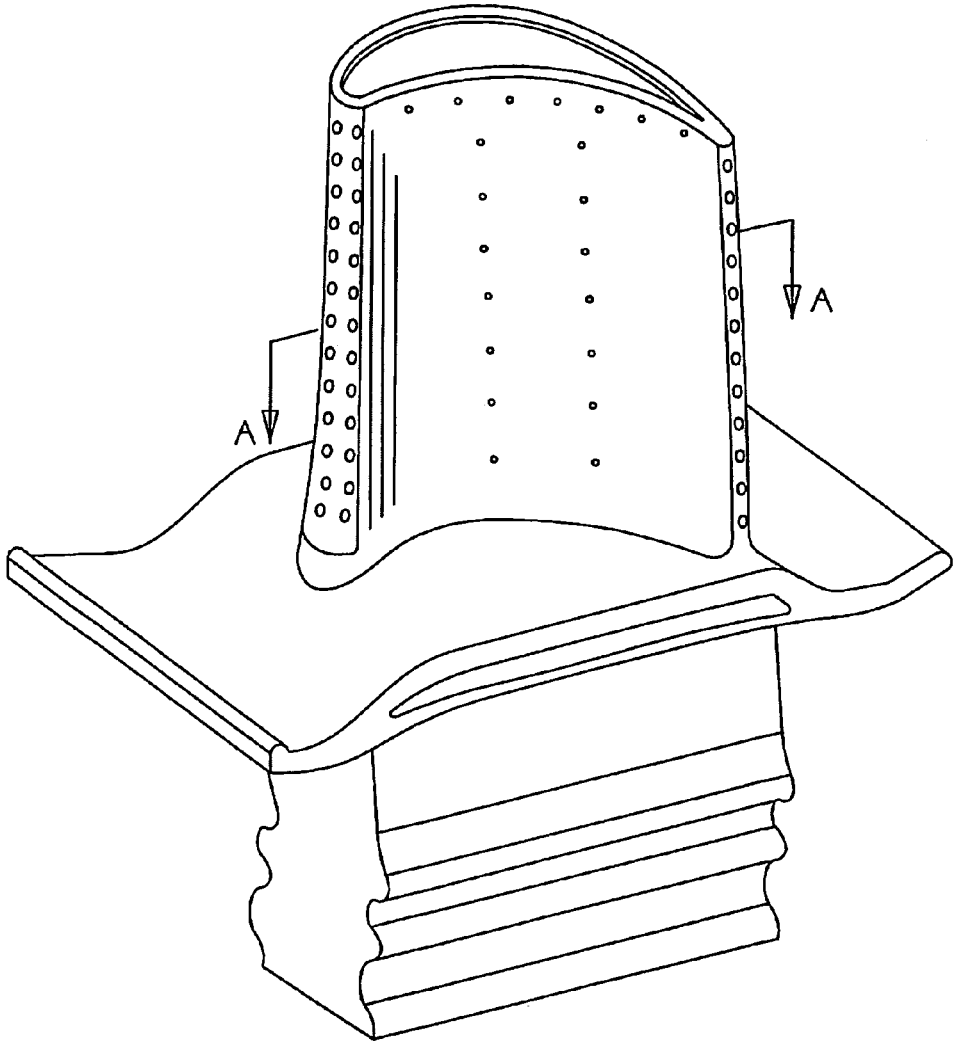
Fig 1 Prior Art
FIG. 1 shows a perspective view of a prior art turbine blade with tip cooling holes.
Figure 2:
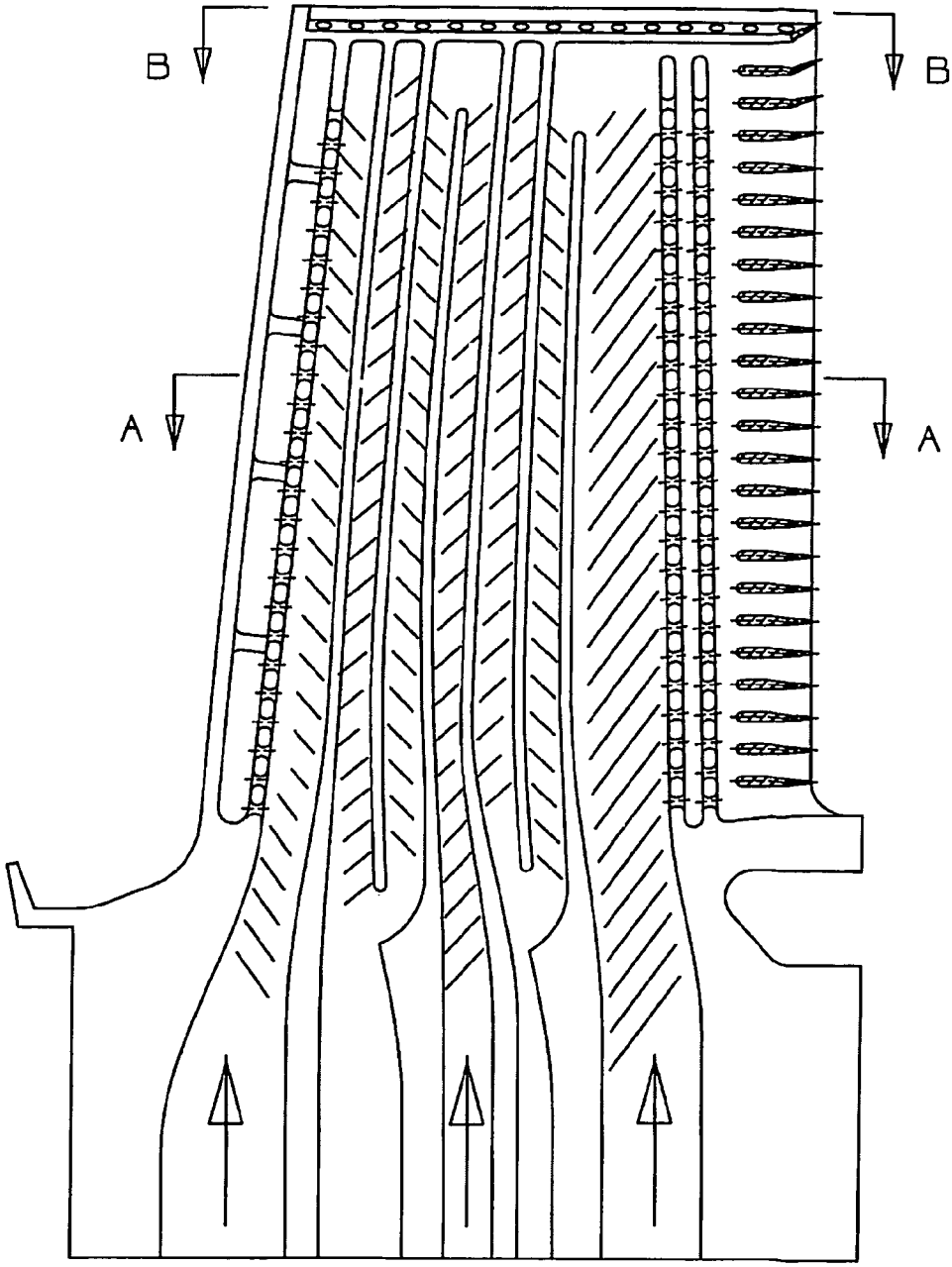
Fig 2 Prior Art
FIG. 2 shows a cross section side view of the prior art blade tip cooling circuit of FIG. 1.
Figure 3:
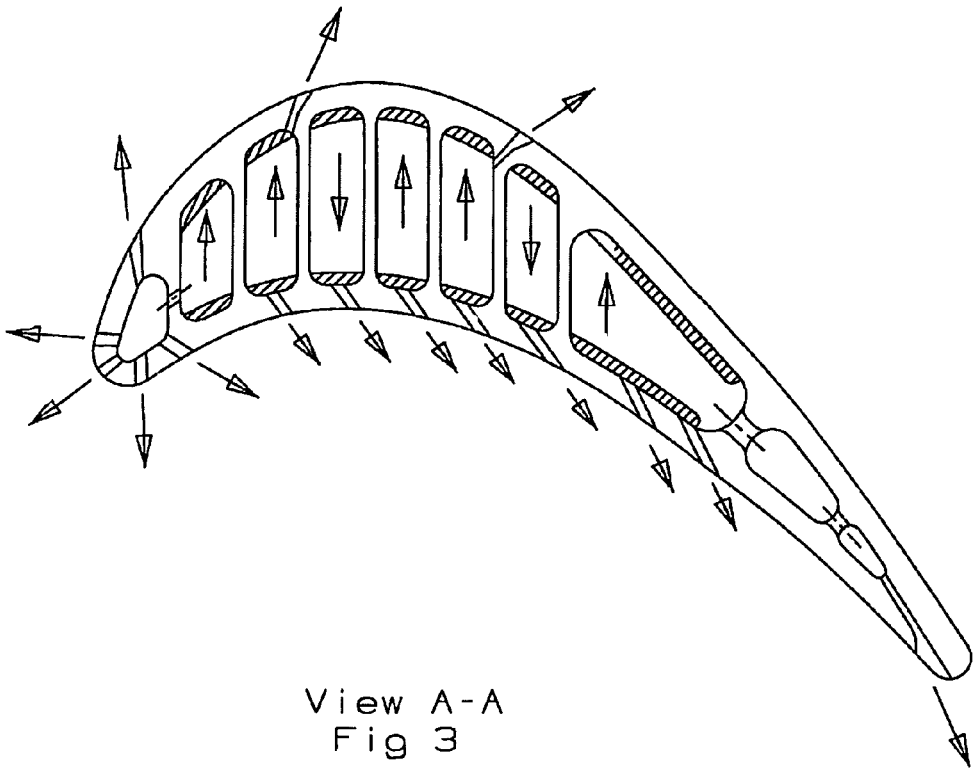
Fig 3 Prior Art
FIG. 3 shows a cross section top view of a prior art blade tip of FIG. 2.

The turbine blade with the tip cooling arrangement of the present invention is shown in FIGS. 1 and 2 where the blade includes a pressure side wall 11 and a suction side wall 12, a blade tip 13 and a serpentine flow cooling passage 14 formed between the wall and the tip 13. The internal cooling channels for the blade that supply cooling air to the vortex channels in the tip can be a single cavity, multiple cavities, or one or more serpentine flow cooling circuits formed within the airfoil body.

Figure 4:
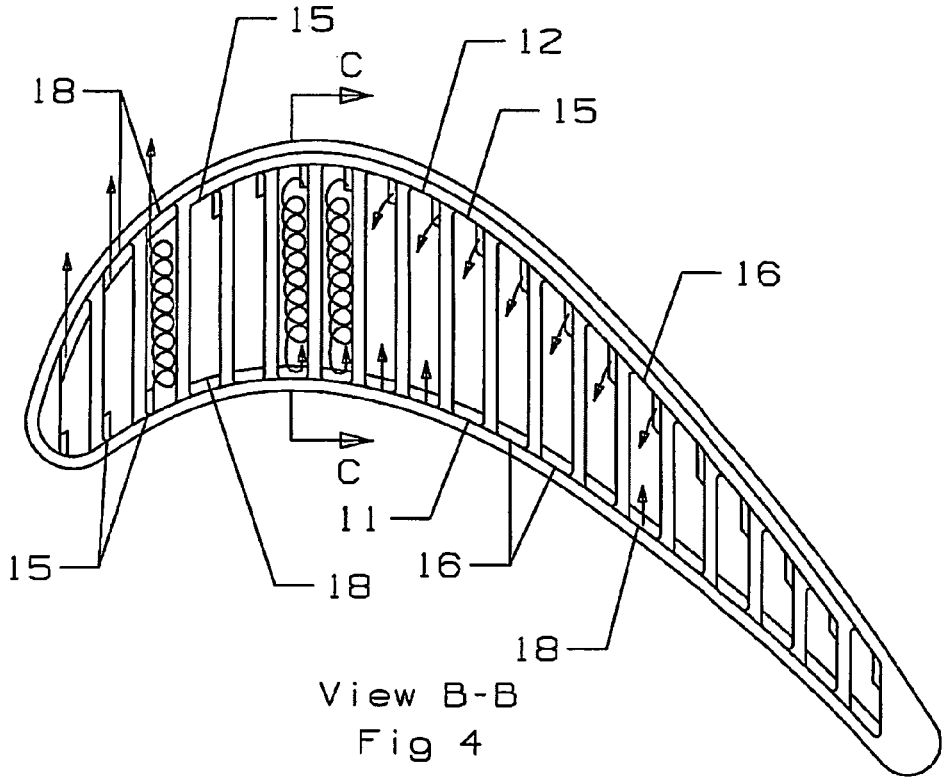
FIG. 4 shows a cross section top view of the blade tip cooling design of the present invention.
Figure 5:
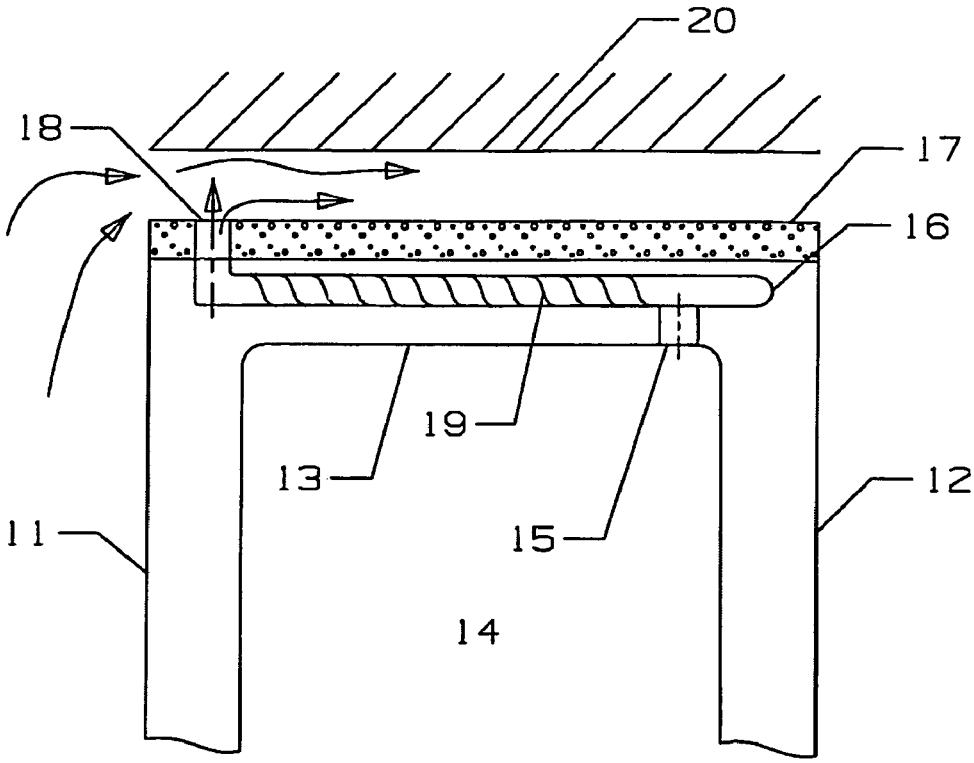
FIG. 5 shows a cross section side view of one of the vortex cooling channels in the blade tip of the present invention.

The blade tip includes an abrasive tip material 17 over the top to form a tip gap with a blade outer air seal 20 of the engine shroud. FIG. 4 shows the blade tip to include a plurality of vortex cooling chambers 16 extending from the walls of the airfoil in a direction substantially parallel to the hot gas flow across the blade tip. Each channel is separated from adjacent channels by a rib so that the cooling air passing through does not mix. Each vortex cooling chamber or channel 16 includes helical ribs extending from an inlet to an outlet to increase the heat transfer coefficient.

Each vortex chamber 16 includes a cooling air feed hole or metering inlet hole 15 located near to the suction side wall 12 of the chamber 16 and a cooling air exit slot 18 located near the pressure side wall of the chamber 16. The inlet holes 15 connect the internal cooling air passage or channel, and the exit slots 18 open onto the tip surface to discharge the cooling air from the chamber 16. FIG. 4 shows the inlet holes 15 to be located in a corner of the chamber 16 and extends along the rib separating adjacent chambers 16. The inlet holes 15 also provide backside impingement cooling for the blade tip. The metering inlet holes 15 can be sized to control an amount of cooling air passing through each cortex chamber depending upon the desired amount of local cooling required for the blade tip. The exit slots 18 are located along the chamber 16 and extend across the pressure side wall 11 in the chamber 16 as shown in FIG. 4. The plurality of vortex chambers 16 extend along the blade tip from the leading edge to the trailing edge as seen in FIG. 4. The vortex chambers 16 also provide impingement cooling to the backside surface of the pressure side wall prior to the cooling air being discharged out through the exit slots 18, the exit slots 18 are oriented or directed to discharge the cooling air at a direction normal to the tip surface or at a direction slightly slanted toward the leakage flow to meet the leakage flow head-on.

In this particular embodiment used in a specific engine, the three vortex chambers on the leading edge region of the blade flow in the opposite direction to the vortex chamber in the remaining regions. This is because—for one particular engine—the hot gas flow flows over the suction side wall of the leading edge region and then back over the suction side wall downstream from the third vortex chamber from the leading edge. By discharging the cooling air out the exit slots 18 along the suction side peripheral, the discharged cooling air will push the hot gas flow away from the blade tip surface. In other engines, this hot gas flow may not occur so all of the vortex chambers can be flowing toward the pressure side wall.

In operation, cooling air delivered to the internal cooling channel 14 will flow through the inlet holes 15 and down the vortex chamber 16 to provide near wall cooling of the blade tip aided by the helical ribs 19. Helical ribs or spiral ribs or even trip strips can be used to promote heat transfer from the chamber wall to the passing cooling air. The cooling air then exits the chambers 16 through the exit holes 18 and out onto the blade tip surface. Convective cooling air to cool the blade tip section is fed from each individual blade serpentine cooling passage through the metering radial inlet hole 15. The cooling air is injected into a series of parallel multiple continuous vortex tubes 16 at locations offset from the axis of the vortex tube. This creates a vortex flow within the continuous chamber 16 or tube. The cooling air flows toward the blade peripheral while whirling within the vortex chamber. The high velocity at the outer peripheral of the vortex chamber 16 generates a high rate of internal heat transfer coefficient and thus provides high cooling effectiveness for the blade tip portion. Since each individual vortex chamber or tube 16 operates as an independent flow circuit, the vortex chambers can be tailored to the local heat load. The metering inlet holes can be sized to regulate the amount of cooling air that passes into the vortex chambers. Helical ribs—or other forms of projections that will promote a vortex flow—can be incorporated onto the inner walls of the vortex chambers to enhance the heat transfer coefficient. The spent cooling air is finally discharged at the top portion of the blade pressure side peripheral to form a layer of cooling air for sealing of the blade leakage flow across the blade tip.

The blade tip cooling design of the present invention allows for the cooling air to impinge onto the backside of the blade edge first and then discharges the cooling air closer to the blade tip portion on the pressure side wall peripheral where the exit cooling air interacts with the secondary leakage flow over the blade tip. The end result is a cooler blade tip and a reduced effective leakage flow area which translates to a lower leakage flow across the blade stage.

Advantages of the present invention over the prior art is the following. 1) The reparability of the blade tip treatment: any blade tip treatment layer can be stripped and reapplied without the possibility of hole plugging or the difficulty of reopening the tip cooling holes. 2) Elimination of the blade tip cooling hole drilling: since the entire cooling scheme can be cast into the blade, drilling cooling holes around the blade tip edge and blade tip top surface can be eliminated. This will reduce the blade manufacturing cost and improve the blade life cycle cost. 3) Elimination of blade core printout holes: horizontal vortex tubes and the metering hole can be used as the blade core print out hole. Elimination of welding of core print out holes is accomplished. Furthermore, this integral blade tip cooling scheme will prevent core shift by interconnecting the horizontal channels. 4) Enhanced coolant flow: individual metering channels allow for tailoring of the tip cooling flow to the various supply and discharge pressures around the airfoil tip. 5) Higher blade cooling effectiveness: since the coolant air is used first to cool the blade main body and then to cool the blade tip section. This doubles the usage of the cooling air to improve the overall blade cooling efficiency. 6) improved blade tip cooling: a higher internal cooling effectiveness level is produced by the vortex cooling mechanism for the blade top surface plus backside impingement cooling for the blade edge than in the prior art individual cooling holes. Also, discharging cooling air at the tip edge will provide film cooling for the blade top surface, resulting in a cooler blade tip section. 7) reduced blade tip leakage flow: the inventive edge discharge geometry enables the exit cooling air to interact with the secondary flow to achieve a lower effective leakage flow area and thus reduce the overall blade tip leakage flow and the heat load on the top of the abrasive layer. 8) Improved turbine stage performance: the reduction of overall leakage flow translates into more hot gas working fluid and better turbine stage performance.

I claim:

1. A turbine blade for use in a gas turbine engine, the blade comprising:

A pressure side wall and a suction side wall;

A blade tip;

An internal cooling air channel formed within the airfoil to provide cooling for the main body of the airfoil;

A plurality of vortex chambers formed in the blade tip to provide near wall cooling of the blade tip, the vortex chambers extending across the blade tip from the pressure side wall to the suction sidewall;

Each of the vortex chambers having a metering inlet hole on the suction side of the chambers connected to the internal cooling air channel to supply cooling air to the vortex chamber; and, Each of the vortex chambers having an outlet slot on the pressure side wall side of the chamber to discharge cooling air through the blade tip.

2. The turbine blade of claim 1, and further comprising:

The metering inlet holes are located on the side of the vortex chamber so that a vortex flow is generated.

3. The turbine blade of claim 1, and further comprising:
The plurality of vortex chambers are separated by ribs and are not fluidly connected together such that cooling air from one vortex chamber can mix into the cooling air of an adjacent vortex chamber.

4. The turbine blade of claim 1, and further comprising:
The blade tip surface is flat without any tip rails that form a squealer pocket; and,
The blade tip surface is covered with an abrasive tip material.

5. The turbine blade of claim 1, and further comprising:
The exit slots for each vortex chamber extend along the end of the vortex chamber from side to side.

6. The turbine blade of claim 1, and further comprising:
The leading edge region of the airfoil includes a plurality of vortex chamber each with an inlet metering hole and an exit slot arranged to pass the cooling air in a direction from the pressure side to the suction side.

7. The turbine blade of claim 1, and further comprising:
The metering inlet holes are arranged to provide impingement cooling of the backside of the blade tip.

8. The turbine blade of claim 1, and further comprising:
The exit slots are located at the end of the vortex chamber and the vortex chamber ends at the airfoil side wall such that impingement cooling of the backside of the side wall is performed before the cooling air exits the exit slots.

9. The turbine blade of claim 1, and further comprising:
The vortex chambers each includes turbulator means to disrupt the cooling air flow to increase the heat transfer coefficient.

10. The turbine blade of claim 1, and further comprising:
The metering inlet holes are sized to provide adequate cooling air flow based upon the blade tip metal temperature profile.

11. The turbine blade of claim 1, and further comprising:
The outlet slots are directed to discharge the cooling air onto the tip surface at a normal direction to the tip surface or at a direction slightly slanted toward the oncoming leakage flow.

12. A process for cooling and seal a blade tip of a turbine blade used in a gas turbine engine, comprising the steps of:
Forming a turbine blade with a tip region having a plurality of vortex chambers extending from the pressure side wall to the suction side wall each separated from adjacent vortex chambers by a rib;
Supplying cooling air to an internal cooling circuit of the blade to provide cooling for the main body of the blade;
Passing a portion of the main body cooling air into the vortex chambers to produce impingement cooling on the backside of the blade tip near the suction side wall;
Passing the cooling air through the vortex chambers in a vortex flow;
Impinging the vortex flowing cooling air against the backside surface of the pressure side wall to provide impingement cooling thereof; and,
Discharging the impinging vortex cooling air through the blade tip surface near the pressure side tip corner of the blade to form a layer of cooling air over most of the blade tip surface.

13. The process for cooling and seal a blade tip of a turbine blade of claim 12, and further comprising the step of:
Forming a plurality of vortex flowing chambers in the leading edge region of the blade tip where the hot gas flow flows over the blade tip from the suction wall side of the blade tip in which the vortex flowing chambers flow from the pressure side to the suction side.

14. The process for cooling and seal a blade tip of a turbine blade of claim 12, and further comprising the step of:
Metering the cooling air into the vortex chambers from a side of the vortex chamber to form the vortex flow in the cooling air.

15. The process for cooling and seal a blade tip of a turbine blade of claim 12, and further comprising the step of:
Discharging the cooling air from the vortex chambers onto the tip surface at a direction normal to the tip surface or at a direction slightly slanted toward the leakage flow.

* * * * *